US008808503B2

(12) United States Patent
Klungness

(10) Patent No.: US 8,808,503 B2
(45) Date of Patent: Aug. 19, 2014

(54) FIBER LOADING IMPROVEMENTS IN PAPERMAKING

(76) Inventor: John Klungness, Bayfield, WI (US)

( * ) Notice: Subject to any disclaimer, the term of this patent is extended or adjusted under 35 U.S.C. 154(b) by 0 days.

(21) Appl. No.: 12/657,998

(22) Filed: Jan. 29, 2010

(65) Prior Publication Data

US 2010/0212853 A1 Aug. 26, 2010

Related U.S. Application Data

(60) Provisional application No. 61/206,713, filed on Feb. 2, 2009.

(51) Int. Cl.
*D21H 17/70* (2006.01)
*D21H 17/63* (2006.01)

(52) U.S. Cl.
USPC ..... 162/183; 162/181.2; 162/181.4

(58) Field of Classification Search
USPC ..... 162/9, 181.2, 181.4, 181.5, 182, 183, 162/207
See application file for complete search history.

(56) References Cited

U.S. PATENT DOCUMENTS

| | | | | |
|---|---|---|---|---|
| 3,097,994 | A * | 7/1963 | Dickens et al. | 162/297 |
| 4,510,020 | A * | 4/1985 | Green et al. | 162/169 |
| 5,223,090 | A | 6/1993 | Klungness | |
| 5,273,625 | A * | 12/1993 | Antolovich | 162/60 |
| 5,772,845 | A * | 6/1998 | Farrington et al. | 162/109 |
| 6,413,365 | B1 * | 7/2002 | Doelle et al. | 162/9 |
| 2004/0166047 | A1 * | 8/2004 | Vogels et al. | 423/432 |
| 2006/0060320 | A1 * | 3/2006 | Doelle | 162/162 |
| 2006/0113051 | A1 * | 6/2006 | Dolle | 162/181.2 |
| 2007/0131360 | A1 * | 6/2007 | Sipila et al. | 162/9 |
| 2007/0151681 | A1 * | 7/2007 | Doelle | 162/9 |
| 2011/0192921 | A1 * | 8/2011 | Virtanen | 241/23 |

FOREIGN PATENT DOCUMENTS

| | | | |
|---|---|---|---|
| WO | WO2005014929 | * | 2/2005 |
| WO | WO2008003827 | * | 10/2008 |

OTHER PUBLICATIONS

Smook, Handbookj of Pulp and Paper Terminology, 1990,Angus Wilde Publications Inc., chapters 11-12.*

Smook, Handbook for Pulp and Paper Technologists, 1992, Angus Wilde Publications, 2nd edition, chapter 16.* www.nano.gov, What is nanotechnology, downloaded online Feb. 27, 2013.* www.nanodic.com, Dictionary definition of nanoscale, downloaded online Mar. 4, 2013.*

Holmes-Farley, Chemistry and the Aquarium:Calcium Carbonate As a Supplement, 2002 [downloaded online Oct. 4, 2013], Advanced Aquarist, p. 1-9.*

Interview # 922 with John Klungness 'Fiber loading, Project Development' (downloaded online http://digital.library.wisc.edu/1711.d1/FPLHist.OH922), Jun. 2009, UW-Madison, History of Forest Product Laboratory.*

Mies, W., Global Overview, Fact & Price Book, 2006, 2, Bedford, MA.

Jacob & Ipst, Pulp and Paper Industry Energy Band Width Study, Proj., No. 16c8700, 2006, AIChE, Atlanta,GA.

(Continued)

*Primary Examiner* — Anthony Calandra

(57) ABSTRACT

A method of making paper includes mixing calcium hydroxide into a water and pulp fiber slurry. The method also includes reacting the calcium hydroxide and pulp fiber slurry under a carbon dioxide pressure. Further, the method includes causing calcium carbonate precipitate to form in response to the reacting.

4 Claims, 5 Drawing Sheets

(56) References Cited

OTHER PUBLICATIONS

Maloney, T.C., et. al., "Comments on the measurement of cell water." Sep. 1999, 125, Tappi Journal.

Carlsson, G., et al., "Expression of water from cellulose fibers under compressive loading," Transactions of the British Paper and Board Industry Federation Symposium on Fiber-water Interactions, 1997, 389-402.Oxford, England.

Stone, J.E., et. al., "The wall density of natural cellulose fibers," Pulp and Paper Magazine of Canada, May 1966, pp. T263-7268.

Gill, R., et al., "The relative effects of different calcium carbonate filler pigments on optical properties," 1987, 93 (70), Tappi Journal.

Downs, T. , A bright future for calcium carbonate, 1990, 39(64), Pulp and Paper.

Allan, G. G., et., al., "The microporosity of pulp: the properties of paper made from fibers filled with calcium carbonate," 1992, p. 239, (75) Tappi Journal.

Rudie, A.W., et, al., "Ion exchange of H+, Na+, Ca++, Mn++, and Ba++, on wood pulp,"2006, 255-272, (26), Journal of Wood Chem. and Tech. (please see Table 1.).

Klungness, J.H., et. al., "Effect of fiber loading on paper properties," 1995, 553, Papermaker's Conference Proceedings, Tappi Press, Atlanta, GA.

Heise, O., et al., "Industrial scaleup of fiber loading deinked waste-paper," 1996, 895, Tappi Pulping Conference Proceedings, Atlanta, GA.

* cited by examiner

FIBER LOADING IMPROVEMENTS IN PAPERMAKING

REFERENCE TO RELATED APPLICATIONS

This disclosure claims the benefit of U.S. Provisional Patent Application No. 61/206,713, entitled FIBER LOADING IMPROVEMENTS IN PAPERMAKING, to John Klungness, filed on Feb. 2, 2009, which is herein incorporated by reference in its entirety.

BACKGROUND

The pulp and paper industry is a large and growing portion of the world's economy. Global production of paper and paperboard is about 360 million tons (Fact & Price Book, 2006, Bedford, Mass., 2006 (ISBN: 1-932126.35.3) and steadily growing. In the U.S., the production of pulp and paper products is about 80 million tons annually, and uses about 4 MMBtu/ton of product in the dewatering process alone (Jacobs and IPST, for AIChE, Pulp and Paper Industry Energy Band Width Study, Proj. No. 16CX8700, 2006,9). The drying techniques, while more effective than mechanical or pressing techniques require excessive space and capital in addition to consuming large quantities of energy.

Accordingly, within the manufacturing process, a better understanding of sheet dewatering is needed to cost-effectively increase solids before the drying to the theoretical limit without compromising sheet structure.

The disclosed innovative approach addresses this very issue.

The disclosure generally relates to improving the press dewatering process during papermaking. These processes include but are not limited to in situ formation of precipitated calcium carbonate (PCC) materials during the fiber loading process by use of a heated press and the use of nano scale particles of, for example, calcium carbonate or calcium hydroxide for displacing the non freezing bound water held mainly in the small pores of wood pulp fibers.

SUMMARY

An aspect of the disclosure relates to a method of making paper. The method includes mixing calcium hydroxide into a water and pulp fiber slurry. The method also includes reacting the calcium hydroxide and pulp fiber slurry under a carbon dioxide pressure. Further, the method includes causing calcium carbonate precipitate to form in response to the reaction.

Another aspect relates to a method of making paper including mixing calcium hydroxide into a water and pulp fiber slurry. The method also includes applying a fiber loading process under a carbon dioxide pressure. Further, the method includes causing PCC to form in response to the fiber loading process.

Yet another aspect relates to a method of making paper. The method includes mixing PCC into a water and pulp fiber slurry. The method also includes applying a fiber loading process. Further, the method includes causing the PCC to displace at least some of the bound water of the fibers in response to the fiber loading process.

Still yet another aspect includes a system for making paper. The system includes a vessel for containing a pulp fiber slurry. The system also includes a pressurized reactor configured to react the pulp fiber slurry with calcium hydroxide to create a fiber loaded precipitated carbonate (FLPCC). Further, the system includes a dewatering subsystem configured to receive a FLPCC material and to reduce the amount of water within the FLPCC.

BRIEF DESCRIPTION OF THE DRAWINGS

A better understanding of the features and advantages of the invention will be obtained by reference to the following detailed description that sets forth illustrative embodiments by way of example only, in which the principles of the invention are utilized, and the accompanying drawings, of which.

DETAILED DESCRIPTION

Figure 1:
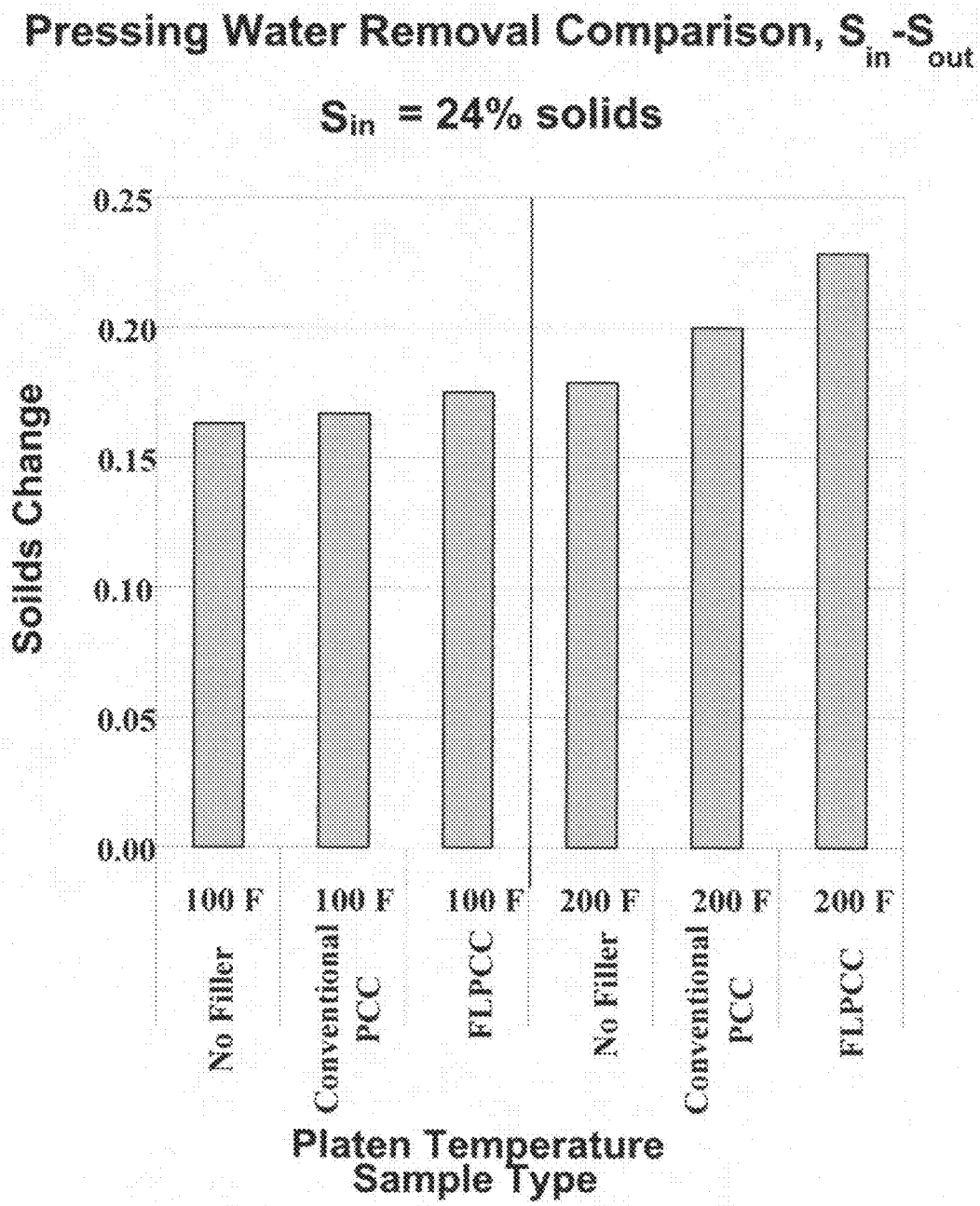
FIG. 1 is an exemplary graph of Pressing Water Removal Comparisons.

Before describing in detail the particular improved system and method, it should be observed that the invention includes, but is not limited to a novel structural combination of processing components, materials, product configurations, and structures, and not in the particular detailed configurations thereof. Accordingly, the structure, methods, functions, control and arrangement of conventional components and processes have, for the most part, been illustrated in the drawings by readily understandable block representations, schematic diagrams, and process diagrams, in order not to obscure the disclosure with structural details which will be readily apparent to those skilled in the art, having the benefit of the description herein. Further, the invention is not limited to the particular embodiments depicted in the exemplary diagrams, but should be construed in accordance with the language in the claims.

The use of in situ formation of precipitated calcium carbonate (PCC) particles in cellulose fibers used for papermaking has been shown to be advantageous. Such a process may result in fibers with reduced water-carrying capacity, increased total sheet PCC content, and a uniform distribution of PCC within the formed sheet. The process may benefit from careful control of temperature, pressure, pH, and pulp slurry consistency to achieve the desired particle size and final location within the fibers.

An exemplary process, accomplished by precipitating calcium carbonate in situ (fiber loading or lumen loading) during the stock preparation process, may be performed using existing fiber processing equipment and will reduce PCC costs by 30% compared with PCC formed prior to addition to the pulp slurry. The process may allow the use of at least 3% more PCC in papermaking. Moreover, the cost of paper machine drying may decrease by more than 20% due to the location of the FLPCC in the wet web during pressing and the increased level of FLPCC due to increased paper strength.

Fiber loading provides a unique low-capital-cost technique for significantly enhancing press-section water removal by in situ formation of PCC filler in the fiber lumen/pores. The PCC filler formation is designed to displace water from intrafiber locations prior to or during the pressing process, thus decreasing the total amount or increasing the ease of water that must be removed from the sheet. Unbound intrafiber water—the greatest mass of water—must be removed if approximately 71% solids (theoretical maximum for non-evaporative water removal) is to be attained. Moreover, the FLPCC is distributed more uniformly and firmly than conventionally added PCC. This uniformity results in a wet web with a reduced PCC barrier on the wire side of the web, resulting in less restriction for water removal by wet pressing.

While there has been work in the area of in situ formation of PCC for filler/lumen loading of papermaking fibers, this earlier work was directed at simply replacing fiber or optimizing final sheet optical properties. In this exemplary technology, the filler loading process is manipulated to produce filler particles which selectively displace water from the fibers and as a result reduce the water carrying capabilities of the fibers. Once the filler is in the web, standard mechanical water removal processes (i.e. pressing) are used to remove water from the web.

A preliminary laboratory study tested the concept of using FLPCC both with and without heated press surfaces. This study addressed the impact of fiber loading on pressing efficiency. Sheets of three types were made using fiber supplied by Wausau Paper, Corp. (Mosinee, Wis.): (1) no filler, (2) conventional PCC, and (3) FLPCC. The filler level for both of the filler sheets was ~25%. Cationic polyaclamide (CPAM) was used as a retention aid in the conventional PCC sheets. Handsheets were made (100 g/m2) and then pressed in the MTS press at IPST-GT. A shoe press type pressing profile was used, with a peak pressure of ~5000 kPA (700 lb/in2). Ingoing solids were maintained at 24%. Outgoing solids ranged from 41% to 46%, depending on the sample. Results are summarized in FIG. 1. No attempt was made to optimize the FLPCC particle size or to optimize the pressing procedure.

Mechanical Dewatering—Pressing

Over the past half-century, a considerable amount of research on parameters controlling press dewatering has been conducted. Previous efforts to improve press dewatering have focused on changing the equipment used in the process. This requires significant capital investment for development and commercialization of the technology and has resulted in only limited success. The last major improvement in press dewatering—extended nip pressing—requires complete replacement of a portion of the press section. Introduced in the early 1980s, it still has not reached full market saturation. Other technologies (impulse drying, displacement dewatering) have not faired as well, at least in part due to the significant capital investment required.

During the same time period, a considerable amount of research on manipulation of sheet physical properties through refining, chemical addition, and filler addition has also been conducted. This work has sometimes addressed the impact on sheet formation but usually from the standpoint of final sheet properties. This work has generally ignored the impact of sheet and fiber changes on sheet dewatering.

Sheet and Fiber Water

In conventional pressing, water removal is induced by compressing the sheet. Sheet compression results in a decrease in average pore size and increase in apparent density. Using peak pressures of up to 7000 kPa (1000 lb/in2), the maximum solids attainable in most press sections is 45% to 50%. Sheet property constraints and wet press felt lifetime limitations often prohibit using press loads of that magnitude. The 40% to 45% solids level represents about the same amount of water as is found in the interfiber pores (i.e., interfiber water or free water). Maloney, T. C., Laine, J. E., and Paulapuro, H., "Comments on the measurement of cell wall water," Tappi Journal (September 1999): 125.

Interfiber water is contained in pore spaces between fibers; these pores generally have diameters of ≥1 μm. Intrafiber water is contained in pores that exist inside the fibers; these pores generally have diameters that range in size from <0.01 to about 0.05 μm. Water in pore spaces ranging in size from ~0.025 to 0.05 μm is not bonded to the fiber and can be removed mechanically. The amount of un-bonded intrafiber water determines the fiber saturation point (FSP), about 71% solids (1.4 to 1.5 g/g). Carlsson, G.; Lindstrom, T.; Soremark, C., "Expression of water from cellulosic fibers under compressive loading," Transactions of the British Paper and Board Industry Federation Symposium on Fiber—Water Interactions in Papermaking. Oxford, England: 389-402, 1977.

A portion of interfiber water (about 0.4 g/g) forms hydrogen bonds with the fibers and is contained in the fiber wall in pores <0.0025 μm. Stone, J. E., Scallan, A. M., Aberson, G. M. A. 1966, "The wall density of native cellulose fibers," Pulp and Paper Magazine of Canada, May: pp. T263-T268, 1966.

The amount of hydrogen-bonded water (sometimes referred to as non-freezing bound water-NFBW) varies insignificantly among different pulps. The amount of this water is affected by neither beating nor drying. It does not depend on sheet treatment. This water cannot be removed mechanically because its removal requires heating to break the hydrogen bonds. It constitutes the limit of water removal by mechanical means and represents a sheet solids content of 1/(1+moisture ratio)=1/(1+0.4)=0.71, or 71% solids.

Experiments indicate that intrafiber water is also removed in the nip. Carlsson, G;. Lindstrom, T;. Soremark, C. 1977. Expression of water from cellulosic fibers under compressive loading. In: Transactions of the British Paper and Board Industry Federation Symposium on Fiber-Water Interactions in Papermaking. Oxford, England: 389-402.

Therefore, the low solids levels attained in conventional pressing imply that the water removal process is not a serial process in which all free water is removed and then intrafiber water is removed. As the sheet is compressed, some intrafiber water is pushed into the interfiber spaces and a portion of it may reach the felt. Some of the interfiber water also enters the felt. However, some of the interfiber water may be absorbed by the fibers, thus becoming intrafiber water. This process is beneficial for development of sheet strength but at the same time limits water removal by conventional pressing. Eventually all interfiber water is removed, although in actual practice some of it may be removed by drying.

Fiber/Lumen Loading—Previous Research

In conventional papermaking, fillers are added for two primary purposes: (1) to modify the final sheet physical properties (optical properties or print quality properties) and (2) to replace fiber with lower cost non-fiber materials. Fillers used just to modify physical properties can be expensive (e.g., titanium dioxide used for sheet brightness and opacity). Fillers used for fiber replacement are of necessity low cost (e.g., kaolin clay, calcium carbonate). The primary problem in using fillers is retention of filler particles in the forming section of the paper machine. Polymers are used to modify filler and/or fiber surfaces charges and promote attachment of filler particles to the fiber surfaces. However, some filler material always drains through the web and enters the paper machine whiter water system, not all of which is recovered. An additional problem is that the sheet strength is reduced when conventional filler techniques are used because filler particles adhere to the exterior of the fibers and decrease the surface area available for fiber—fiber bonding.

The shift to alkaline conditions in papermaking has been prompted by the increased level of filler permitted in alkaline-sized papers. Because alkaline conditions enhance paper strength, a higher level of filler can be incorporated into the sheet. Calcium carbonate, a filler that could not be used in acid-sized papers, is popular as a filler in alkaline-sized papers because of its high brightness level. Gill, R. and Scott, W., "The relative effects of different calcium carbonate filler pigments on optical properties," Tappi Journal 70: 93, 1987. Downs, T., "A bright future for calcium carbonate," Pulp and Paper 64: 39, 1990. If filler is added into the lumen of wood fibers, interfiber bonding may be maintained. Incorporating filler into the lumen of wood fibers has been the subject of extensive research. Scallan, A. M., and Middleton, S. R., "Lumen loaded paper pulp," Papermaking Raw Materials, Transactions of the symposium held at Oxford, England: p. 613, 1985. These references reported the first studies as lumen loading. An excess of titanium dioxide was mechanically mixed with a pulp slurry, depositing titanium dioxide within the fiber lumen. Limitations of this method were the large excess of titanium dioxide required for lumen loading and the need for a separate process for recycling excess filler. More recent studies on cell wall loading were reported by Allan and associates. Allan, G. G., Negri, A. R., and Ritzenthaler, P., "The microporosity of pulp: the properties of paper made from fibers internally filled with calcium carbonate," Tappi J. 75: 239, 1992.

Their approach was to saturate pulp fibers with sodium carbonate and to react the resulting pulp mixture with salt containing calcium (e.g., calcium chloride). However, additional processing was required to remove the salt remaining in the mixture.

Fiber loading technology developed at FPL consists of at least two steps as described in Klungness, J., Caulfield, D., Sachs, I., Sykes, M., Tan, F., and Shilts, R., "Method for fiber loading a chemical compound," U.S. Pat. No. 5,223,090 (Jun. 29, 1993), RE35, 460 (Feb. 25, 1997), which are herein incorporated by reference in their entirety.

In one embodiment of the invention the nanoscale calcium hydroxide is added to dewatered crumb pulp to form a pulp mixture of 5% to 60% solids by weight. In an additional embodiment of the invention the pulp mixture is contacted in a pressurized refiner with carbon dioxide in a high shear mixing process in order to precipitate calcium carbonate partly within the cell walls. In a further embodiment the pressure of the carbon dioxide can be 5 to 60 psig.

First, calcium hydroxide is mixed into a pulp fiber slurry. Then the pulp and calcium hydroxide mixture is reacted using a high-consistency pressurized reactor (refiner or disk disperser) under carbon dioxide pressure to precipitate calcium carbonate. Calcium carbonate formed is termed fiber-loaded precipitated calcium carbonate (FLPCC). The technology increases brightness, opacity, bonding properties, and runnability of the paper machine.

Unpublished FPL data indicate that non-uniformity of filler distribution during handsheet formation results in decreased water removal during wet pressing and that fiber loading results in more uniform filler distribution. This result is expected, considering that most pressing research has shown that uniformity of pressure application enhances water removal and that incompressible filler particles that are not uniformly distributed produce pressure non-uniformity. The positively charged calcium hydroxide and the subsequent positively charged FLPCC are believed to be more firmly attached to the negatively charged wood pulp fibers than is the PCC, which becomes increasingly negatively charged with age. The filler barrier layer on the wire side of the web is less pronounced with FLPCC than with conventionally added PCC. Moreover, consistency during mixing may have a significant effect on fiber loading, resulting in a savings in equipment costs. Using readily available refiners, which can precipitate pulp at about 5% consistency, will result in significant equipment cost savings.

The improvement in pressing results, may be too great to be explained entirely by improved fiber formation and filler distribution, and may be further explained by the displacement of chemically bound water by calcium ions. Calcium ions, which are present in equilibrium in calcium hydroxide and freshly precipitated FLPCC, are well known to have a great affinity for the hydroxyl and carboxyl groups of cellulose. Rudie, A. W., Ball, A., and Patel, N., "Ion exchange of H+, Na+, Mg2+, Ca2+, Mn2+, and Ba2+, on wood pulp," Journal of Wood Chem. and Tech. 26: 255-272., 2006.

Heating calcium compound containing pulp mixtures increases the solubility of most calcium compounds. Not only are such calcium ions relatively more attracted to wood pulp hydroxyl and carboxylic acid groups (and other negative chemical groups in wood pulps) than other cations, but increasingly attracted to wood pulp with increasing concentration of the ions in solution. Rudie et al. The heated wet web at increasing solids content of up to 40% in the wet pressing process increases the calcium ion concentration. Both heating and increasing calcium ion concentration, coupled with the pumping action occurring to the pulp in the wet press, as described by Carlsson earlier, which allows the intra fiber water to become inter fiber water, increase the likelihood of calcium displacing the non freezing bound water associated with wood pulps.

Hydroxyl and carboxyl groups are involved with hydrogen bonding of chemically bound water. Displacement of chemically bound water by calcium ions will have a positive effect on the energy required for both pressing and drying. Greater energy is required for both pressing and drying chemically bound water than for non-chemically bound water.

Fiber/Lumen Loading—Previous Pilot-Scale Work

Two industrial evaluations of fiber loading have been published: The first, Klungness, J., Sykes, M., Tan, F., AbuBakr, S., and Eisenwasser, J., "Effect of FL on paper properties," Tappi 1995 Papermakers Conference Proceedings, Atlanta, Ga.: Tappi Press. p. 553, 1995., involved fiber loading virgin never-dried birch hardwood bleached kraft pulp. The fiber-loaded pulp was processed on a pilot-scale paper machine. The paper machine trials revealed some technical obstacles. Changes in color and brightness, cross-machine web shrinkage, and apparent paper density increases were observed and became the focus of follow-up laboratory evaluations.

The problems were duplicated in the laboratory, and methods for preventing or overcoming the obstacles were developed. Including a low level of hydrogen peroxide addition to the pulp slurry prevented brightness loss and yellowing of the fiber-loaded pulp. Web shrinkage occurred before the paper machine cross-machine-direction restraint rolls and was tracked to greatly improved water removal for fiber-loaded pulps compared with conventional pulps. Filler retention was shown not to be a problem with fiber-loaded pulps. Apparent density was increased by about 10% for fiber-loaded pulps. Laboratory handsheet experiments demonstrated that increased use of high bulk pulps e.g., thermomechanical (TMP) pulp restored the loss in bulk.

The second published industrial evaluation of fiber loading involved deinked mixed office wastepaper. Heise, O., Fineran, W., Klungness, J., Tan, F., Sykes, M., AbuBakr, M., and Eisenwasser, J. 1996. 1996 Tappi Pulping Conference Proceedings, Oct. 27-31, 1996; Nashville, Tenn. Atlanta, Ga.: TAPPI Press. 895.

Conventional deinking mill conditions were simulated. Industrial-scale fiber loading was technically successful; calcium hydroxide was completely converted to PCCVte and deposited on the external and internal surfaces of pulp fibers. The fiber loading processes used in the trials needed to be modified to obtain optimum rate of conversion to calcium carbonate.

In accordance with an exemplary embodiment, the technology is to significantly enhance press dewatering, which provides a direct savings in energy required for drying. Assuming that the only change is a reduction in water delivered to the dryer section, a 1% increase in sheet solids entering the dryer section will yield a 4% reduction in energy used for drying. Therefore, if the outgoing press solids were increased from 45% to 65%, energy used for drying would be reduced by (65−45)×4%=80%. Few, if any, technologies will simply increase water removal without requiring some other energy input or resulting in some change to the sheet that could either enhance or degrade the sheet properties or the drying process.

The disclosed technology makes use of filler addition and web heating. Energy costs associated with the technology include (1) heating the pulp prior to the conversion/filler loading process and (2) heating the web prior to or during the process.

Neither of these requires evaporation of water and both can be accomplished using steam condensation, which provides a large heat flux for a relatively small amount of steam. The energy cost of heating is more than offset by improvements in process efficiencies. Heating the pulp prior to the conversion/filler loading process results in a more conformable fiber that is more easily refined, with reduced refining energy requirements and reduced fiber damage. Heating the sheet prior to pressing produces, in addition to the well-documented dewatering benefits from reduced water viscosity, a more conformable fiber, which enhances web bonding, and potentially results in higher final sheet strength and opacity. An often overlooked aspect of significantly increasing press dewatering is the reduction in required dryer capacity. Smaller changes are typically taken as production increases. A significant change can result in a reduction in the size of the dryer section, which in turn results in a decrease in air handling, steam handling, number of motors and dryer cans, and machine size. The dryer section constitutes more than half the length of a paper machine. A smaller dryer section requires a smaller building.

An additional benefit may reduce the amount of energy needed to evaporate water from the paper web in the dryer section of the paper machine. Heating the web somewhat solubilizes the PCC to displace the NFBW. Reduction of NFBW by displacement with calcium ions may not only increase pressing efficiency but also decrease energy needed to dry paper.

Because the disclosed technology relies on the use of filler, the amount of fiber used is correspondingly reduced. Reduced fiber content has energy, environmental, and economic benefits. In addition to less water being held in any given fiber because of its replacement by filler, less total fiber in the sheet also results from its replacement by filler. One obvious benefit is that filler does not retain water in its structure, thus total water in the sheet is reduced. Another benefit is that less total fiber must be acquired, pulped, bleached, and refined. A reduction in fiber, which can constitute greater than 25% of the total cost of the final product, directly affects production costs. The indirect benefits are reduced requirements for pulping, bleaching, and refining. Reductions in these processes result in reduced energy use, and three of the most energy-intensive processes in papermaking are pulping, refining, and drying. These processes can constitute more than 50% of the total energy use. Reduced pulping and bleaching also result in reduced effluents from those processes.

An additional benefit is in final sheet properties, particularly sheet strength. The disclosed technology places about 25% of the filler up to a limit of around 4-5% filler inside the fiber. Conventional filler addition processes rely on attaching the filler particles to the outside surface of the fiber. In the later case, a reduction of fiber-fiber bond area results in a reduction in sheet strength, both in-plane and out-of-plane. A FLPCC sheet will have higher strength than a conventional sheet, which could allow for further fiber use reductions or enhanced sheet functionality.

Figure 2:
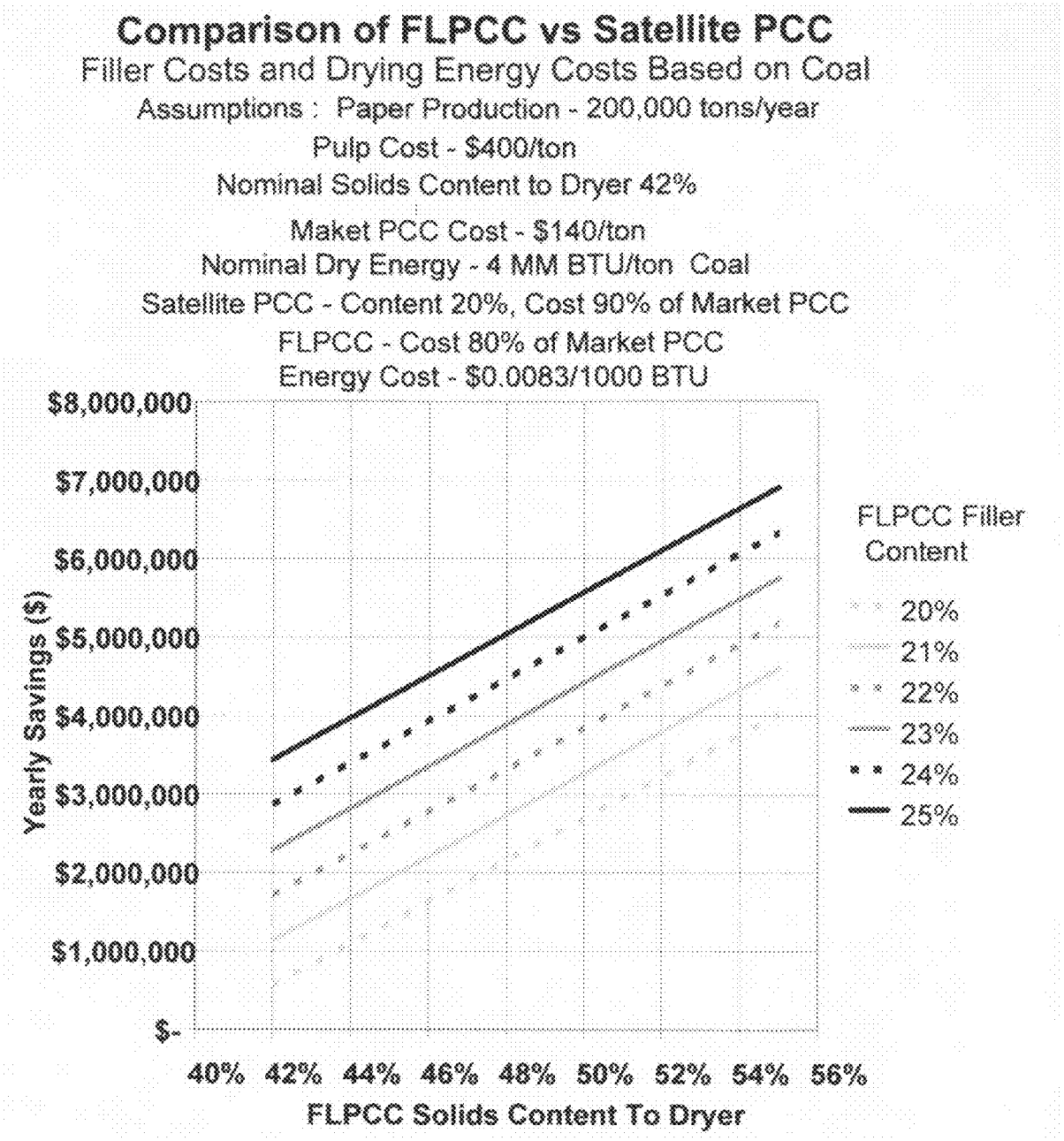
FIG. 2 is an exemplary graph comparing the use of FLPCC and PCC produced at a satellite plant.
Figure 3:
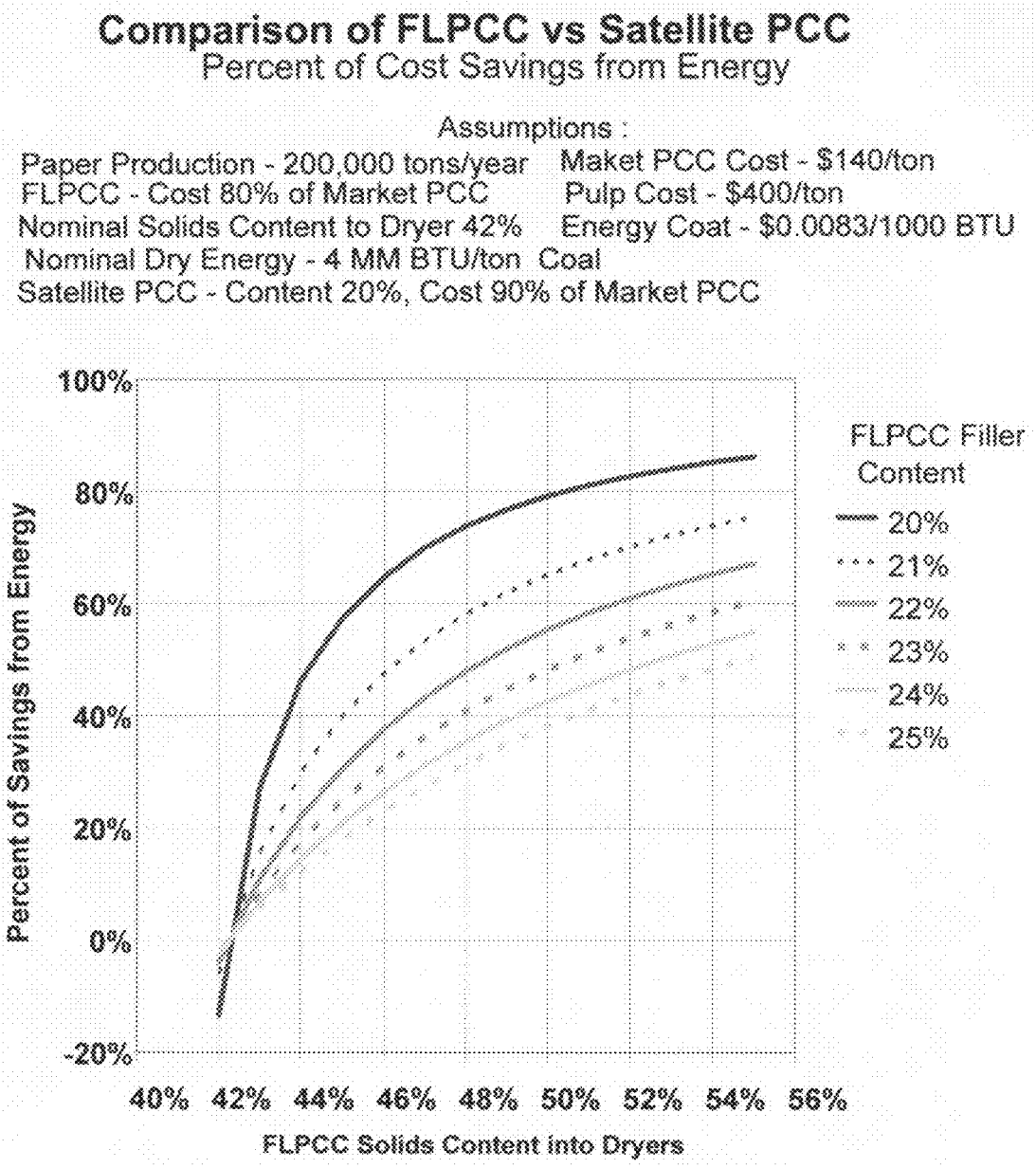
FIG. 3 is an exemplary graph depicting the percentage of cost savings derived from energy savings.
Figure 4:
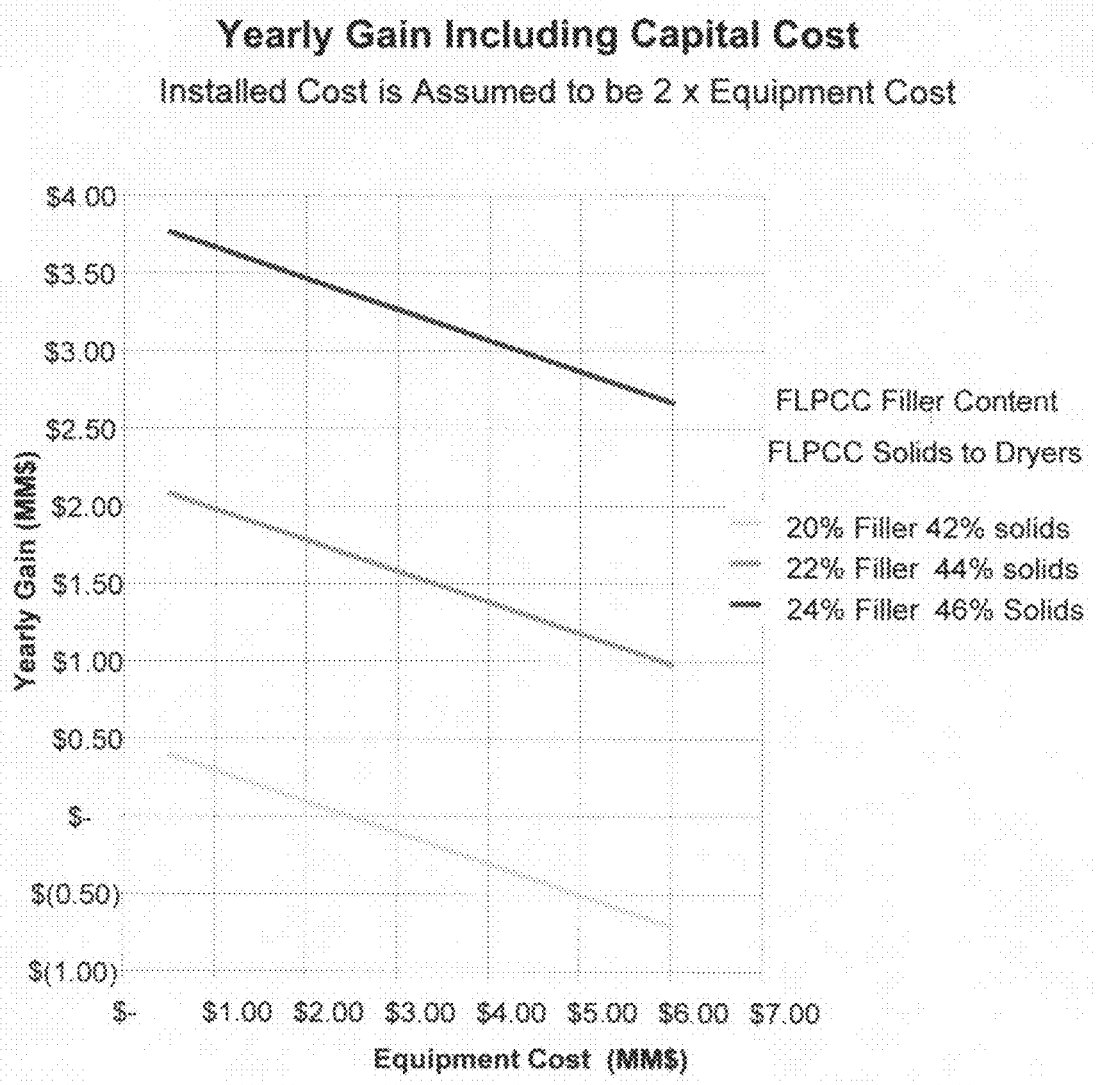
FIG. 4 is an exemplary graph depicting the financial results when capital costs are taken into account and showing that cost can be recovered with relatively modest performance of the system.

The cost and energy benefits are illustrated in FIG. 2, which compares the use of FLPCC and PCC produced at a satellite plant. The graph takes into account heating the pulp mixture [21° C. (70° F.) to 65° C. (150° F.)] prior to the conversion step and preheating the wet web [40° C. (104° F.) to 100° C. (150° F.)] prior to pressing. In both cases, the efficiency of the heating operation is assumed to be 50%. The energy used to accomplish the heating is subtracted from that saved in the dryer section. The resultant monetary savings are then based on the energy cost shown in the figure. Because refining will be performed regardless of whether the FLPCC filler is used, heating will be the major operating cost associated with the technology. FIG. 3 shows the percentage of cost savings that were derived from energy savings. FIG. 4 shows the financial results when capital costs are taken into account and shows that cost can be recovered with relatively modest performance of the system. The capital costs were spread over a 10-year period. While the graph shows a range of capital costs, the actual cost will be in the range of $1 to 1.5 million (two installed refiners @$250,000 each; blend chest with pumps @$250,000; steambox, if required, @$400,000).

In summary, the benefits of the proposed technology include the following:

Energy

Reduced drying energy—increased press dewatering

Reduced drying energy—fiber replacement

Reduced refining energy—high consistency, higher pH

Reduced pulping requirements—fiber replacement

Environmental

Reduced pulping requirements—fiber replacement

Reduced bleaching requirements—fiber replacement

Economic

Enhanced final sheet properties—conformable fibers and web

Enhanced final sheet properties—increased fiber-fiber bond area

Reduced dryer section size—increased press dewatering

Reduced capital equipment—in situ PCC production

Nano Scale Particles

Another exemplary embodiment is related to the use of nano scale particles of calcium carbonate or calcium hydroxide for displacing the NFBW held mainly in the small pores of wood pulp fibers. The NFBW comprises up to 30 percent of the weight of the dry fibers. This NFBW, is more difficult to remove in the pressing and drying stages of paper manufacture than either freezing bound water or free water associated with pulp fibers.

The difficulty is due to the location of the NFBW inside internal pores of less than four nano meters diameter, and the chemical bonding of NFBW to carboxyl and hydroxyl groups located inside the nano pores of the pulp fibers. The NFBW is relatively difficult to remove by pressing and has a higher specific heat than freezing bound water and free water associated with pulp fibers. The specific heat of the NFBW is higher than the other two types of water associated with fiber, which make the drying process of NFBW less energy efficient.

Using either nano particles of, for example, calcium hydroxide or calcium carbonate will allow the compounds to become soluble. Alternatively other suitably sized particles may also be used. In the usual particle size the solubility of such particles is only minimal. This low solubility only permits a small portion of the NFBW to be displaced by the calcium compounds which have great affinity for the hydroxyl and carboxyl compounds associated with the pores of the fibers. The nano scale pores typically comprises 98% of the internal surface area of pulp fibers.

The application of the particles may be directly added to pulp slurry, in the case of calcium carbonate, or in a two step mixing in the pulp slurry followed by reaction process with calcium hydroxide. That is, for example, mix calcium hydroxide followed by reaction in a pressurized refuter. The pressure in the refiner may be supplied by carbon dioxide for the chemical reaction. The pressurized refiner can thus be used as an efficient chemical reactor.

This concept allows calcium carbonate or calcium hydroxide to become much more soluble than is presently the case, and it allows these soluble ions to behave in a new way, i.e., displace NFBW from wood pulp paper making fibers.

Exemplary embodiments may therefore include NFBW displacement for water removal in the paper manufacturing process by: 1) heating, or 2) particle size reduction of fiber loaded calcium carbonate (FLPCC) or the precursor salts:

Heating

Figure 5:
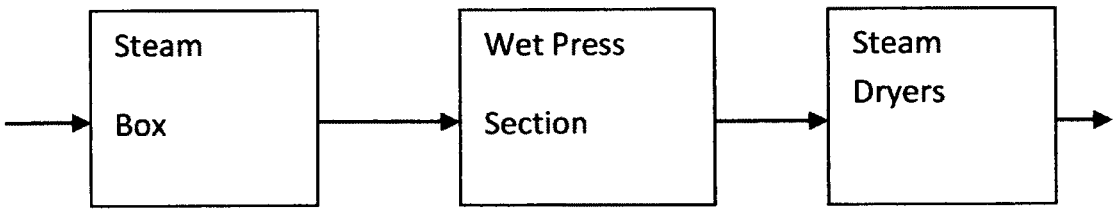
FIG. 5 is an exemplary process diagram of wet press removal of non-freezing bound water NFBW).

A paper web containing calcium carbonate may be subjected to heating by means of a conventional steam box or boxes prior to entering the press section of the paper making process, as depicted in FIG. 5. By so doing fiber loaded calcium carbonate particles may become somewhat more soluble and tend to displace NFBW tightly held by wood pulp fibers. The positively charged ions created by heating readily displace the NFBW held in the nano scale capillaries of the wood pulp fibers. The hydroxyl and carboxyl and other negatively charged groups of the wood pulp fibers which attract and hold the NFBW, are more attracted to the calcium ions than to the NFBW molecules.

We have laboratory scale experimental evidence of improvements in wet press removal of NFBW. Alternatively, we have also observed industrial scale evidence of improved water removal by simply drying the paper web containing fiber loaded calcium carbonate compared to conventional calcium carbonate.

Particle Size Reduction

In another exemplary embodiment, by reducing the size of FLPCC or calcium hydroxide [Ca(OH)2] used to produce FLPCC, the FLPCC will become more soluble that standard PCC. The more soluble form of FLPCC thus forms sufficient calcium ions (approximately 0.6 nm in diameter) to displace NFBW largely contained in the internal pores of wood pulp fibers which are four nm or less in diameter.

Calcium ions have been noted in the literature as having a strong affinity for wood pulp fibers. This is attributed to the unique configuration of the electron orbital which is strongly attracted to the negatively charged groups such as hydroxyl and carboxyl groups which hold the NFBW. Thus, calcium ions may have a stronger affinity for the hydroxyl and carboxyl groups than NFBW, and thus displace the NFBW. Displacing the NFBW is a large advantage in removing water from pulp in paper manufacture.

Alternatively, any other inorganic and organic salts of calcium as well as any cation which may be an effective alternative in displacing NFBW.

While the detailed drawings, specific examples, and particular formulations given described exemplary embodiments, they serve the purpose of illustration only. It should be understood that various alternatives to the embodiments of the invention described maybe employed in practicing the invention. It is intended that the following claims define the scope of the invention and that structures within the scope of these claims and their equivalents be covered thereby. The configurations shown and described may differ depending on the chosen performance characteristics and physical characteristics of the resultant products. The products shown and described are not limited to the precise details and conditions disclosed. Method steps provided may not be limited to the order in which they are listed but may be ordered any way as to carry out the inventive process without departing from the scope of the invention. Furthermore, other substitutions, modifications, changes and omissions may be made in the design, operating conditions and arrangements of the exemplary embodiments without departing from the scope of the invention as expressed in the appended claims.

The invention claimed is:

1. A method of making paper, comprising:

providing a cellulosic fibrous material comprising a plurality of elongated fibers having a fiber wall surrounding a hollow interior, the fibrous material having moisture present at a level sufficient to provide the cellulosic fibrous material in the form of dewatered crumb pulp;

heating the dewatered crumb pulp, in a first heating process by adding heat energy to the dewatered crumb pulp in a steam condensation process;

adding calcium hydroxide particles to the dewatered crumb pulp, after the first heating process, to form a pulp mixture having between 5% and 60% solids by weight, in a manner such that at least some of the calcium hydroxide becomes associated with the water present in the pulp mixture and the calcium hydroxide particles added have a mean nano-scale particle size in order to increase the rate of solubility for calcium ion release;

contacting, in a pressurized refiner, said pulp mixture with carbon dioxide and high shear mixing in order to precipitate calcium carbonate partly within the cell walls of said fibrous material and displacing bound water;

forming a web from the pulp mixture that has been subjected to the heating and the high shear;

heating the web by adding energy in a steam box; and wet pressing the web.

2. The method of claim 1, further comprising:

drying the web.

3. The method of claim 1, wherein the mean particle size is in the range of 1 nm to 100 nm.

4. The method of claim 1, wherein the carbon dioxide includes gas in the range of 5 to 60 psig.

* * * * *